US005550353A

United States Patent [19]

Peysakhovich et al.

[11] Patent Number: 5,550,353

[45] Date of Patent: Aug. 27, 1996

[54] INDUCTION HEATING COIL ASSEMBLY FOR PREVENT OF CIRCULATING CURRENT IN INDUCTION HEATING LINES FOR CONTINUOUS-CAST PRODUCTS

[75] Inventors: Vitaly Peysakhovich, Moorestown, N.J.; Nicolas P. Cignetti, North Canton, Ohio; Hans G. Heine, Red Bank; John H. Mortimer, Mt. Laurel, both of N.J.

[73] Assignee: Inductotherm Corp., Rancocas, N.J.

[21] Appl. No.: 384,080

[22] Filed: Feb. 6, 1995

Related U.S. Application Data

[63] Continuation-in-part of Ser. No. 107,427, Aug. 16, 1993, Pat. No. 5,416,794, which is a continuation-in-part of Ser. No. 19,921, Feb. 19, 1993, Pat. No. 5,425,048, which is a continuation-in-part of Ser. No. 532,010, Jun. 1, 1990, Pat. No. 5,272,720, which is a continuation-in-part of Ser. No. 473,000, Jan. 31, 1990, Pat. No. 5,257,281.

[51] Int. Cl.[6] ..... H05B 6/36

[52] U.S. Cl. ..... 219/672; 219/647; 219/653; 373/153

[58] Field of Search ..... 219/672, 674, 219/676, 635, 636, 637, 643, 653, 602, 607, 624, 647; 373/151–155; 156/498

[56] References Cited

U.S. PATENT DOCUMENTS

| | | | |
|---|---|---|---|
| 1,023,309 | 4/1912 | Helberger . | |
| 1,235,630 | 8/1917 | Wyatt . | |
| 1,682,388 | 8/1928 | Lincoln . | |
| 1,684,800 | 9/1928 | Maximoff et al. . | |
| 1,743,956 | 1/1930 | Bunet . | |
| 1,795,842 | 3/1931 | Davis . | |
| 1,852,214 | 4/1932 | Northrup . | |
| 1,879,360 | 9/1932 | Linnhoff . | |
| 2,253,421 | 8/1941 | de Maré | 75/13 |
| 2,448,009 | 8/1948 | Baker | 219/637 |
| 2,852,587 | 9/1958 | Junker | 13/27 |
| 2,929,906 | 3/1960 | Connelly | 219/10.79 |
| 2,946,834 | 7/1960 | Junker | 13/27 |
| 2,969,411 | 1/1961 | Gibbs | 13/27 |
| 3,004,091 | 10/1961 | Tama et al. | 13/27 |
| 3,154,404 | 10/1964 | Lorenz | 75/10 |
| 3,177,282 | 4/1965 | Kasper et al. | 13/27 |
| 3,303,258 | 2/1967 | Junker | 13/27 |
| 3,314,670 | 4/1967 | Kennedy | 266/34 |
| 3,320,348 | 5/1967 | Seulen et al. | 13/27 |
| 3,335,212 | 8/1967 | Seulen et al. | 13/27 |
| 3,461,215 | 8/1969 | Reboux | 13/27 |
| 3,700,779 | 10/1972 | Pomey | 13/26 |
| 3,703,601 | 11/1972 | Babel | 13/27 |
| 3,704,336 | 11/1972 | Synnestvedt | 13/27 |
| 3,709,678 | 1/1973 | Helary et al. | 75/10 R |
| 3,883,386 | 5/1975 | Garbini et al. | 219/637 |
| 4,183,508 | 1/1980 | Michelet et al. | 266/242 |
| 4,336,411 | 6/1982 | Hanas et al. | 373/85 |
| 4,339,625 | 7/1982 | Delassus et al. | 373/158 |
| 4,351,058 | 9/1982 | Florian et al. | 373/155 |

(List continued on next page.)

FOREIGN PATENT DOCUMENTS

| | | |
|---|---|---|
| 2368542 | 5/1978 | France . |
| 56-53868 | 5/1981 | Japan . |

OTHER PUBLICATIONS

*DETEM Plant and Process Description,* Technometal (publication date unknown).

*Asea Calidus* Brochure (publication date unknown).

*Primary Examiner*—Tu Hoang

*Attorney, Agent, or Firm*—Seidel, Gonda, Lavorgna & Monaco, P.C.

[57] ABSTRACT

An induction heating coil assembly for use in a roller induction heating line has a magnetic shunt for receiving a portion of an electromagnetic field generated along the axis of the induction coil and directing that portion along a path parallel to a workpiece passing along the heating line. This flux path ensures that eddy currents induced in the workpiece flow primarily perpendicular to the axis of the workpiece, and not along the axis of the workpiece where they could cause arcing between the moving workpiece and the conveyor rolls.

12 Claims, 11 Drawing Sheets

U.S. PATENT DOCUMENTS

| | | | |
|---|---|---|---|
| 4,386,255 | 5/1983 | Berkman et al. | 219/10.49 R |
| 4,410,796 | 10/1983 | Wilsey | 219/553 |
| 4,411,412 | 10/1983 | Lechevallier | 266/242 |
| 4,432,093 | 2/1984 | Reboux | 373/157 |
| 4,446,563 | 5/1984 | Willay | 373/157 |
| 4,583,230 | 4/1986 | Komada et al. | 373/156 |
| 4,618,964 | 10/1986 | Larsson et al. | 373/155 |
| 4,715,041 | 12/1987 | Bühler et al. | 373/72 |
| 4,873,698 | 10/1989 | Boen | 373/156 |
| 4,969,158 | 11/1990 | Larson et al. | 373/152 |
| 5,257,281 | 10/1993 | Cignetti et al. | 373/155 |
| 5,272,720 | 12/1993 | Cignetti et al. | 373/155 |
| 5,416,794 | 5/1995 | Cignetti et al. | 373/153 |
| 5,425,048 | 6/1995 | Heine et al. | 373/151 |

INDUCTION HEATING COIL ASSEMBLY FOR PREVENT OF CIRCULATING CURRENT IN INDUCTION HEATING LINES FOR CONTINUOUS-CAST PRODUCTS

CROSS-REFERENCE TO RELATED APPLICATIONS

This is a continuation-in-part application of application Ser. No. 08/107,427 filed Aug. 16, 1993, U.S. Pat. No. 5,416,794, which is a continuation-in-part of Application Ser. No. 08/019,921 filed Feb. 19, 1993, U.S. Pat. No. 5,425,048, which is a continuation-in-part of Application Ser. No. 07/532,010 filed on Jun. 1, 1990, now U.S. Pat. No. 5,272,720, which is a continuation-in-part of Application Ser. No. 07/473,000 filed Jan. 31, 1990, now U.S. Pat. No. 5,257,281, the disclosures of each of which are incorporated herein by reference.

FIELD OF THE INVENTION

The present invention relates to induction heating of continuous-cast products such as slabs, billets, bars, and the like.

BACKGROUND OF THE INVENTION

It is often desired to heat continuous-cast products (e.g., slabs, billets, or other workpieces) as they are conveyed along a path from one location to another. Typically, such products are conveyed by conveyor rolls, which support the product from below and are driven to impart linear motion to the product.

A typical roller induction heating line 10 for continuous-cast products according to the prior art is illustrated schematically in FIG. 1. A continuous-cast product such as a tubular workpiece 12 is conveyed from right to left as viewed in FIG. 1 by steel conveyor rolls 14 and 16. Conveyor rolls 14 and 16 are journaled for rotation in a supporting frame, and are rotationally driven, in known manner, in a counterclockwise direction as viewed in FIG. 1. The rotation of conveyor rolls 14 and 16 imparts linear movement of the tubular workpiece 12 from right to left as indicated by the large arrow at the top of FIG. 1.

As the tubular workpiece 12 is conveyed by conveyor rolls 14 and 16, it passes through an induction heating coil 18. The induction heating coil 18 is a conventional helically-wound coil known in the art. The induction heating coil 18 is excited by a high frequency ac power supply 20, also known in the art, and generates an electromagnetic field through which the tubular workpiece 12 passes. Typically, the tubular workpiece 12 is positioned so that its axis is collinear with the axis of coil 18. The electromagnetic field produced by induction coil 18 induces the flow of eddy currents in the tubular workpiece 12. The electrical resistance of the tubular workpiece 12 to the induced eddy currents results in $I^2R$ heating of the tubular workpiece 12.

Problems arise, however, because the induction coil 18 generates a small, but non-negligible, component of the electromagnetic field perpendicular to the axis of the coil and, thus, along the axis of the tubular workpiece 12. This component of the electromagnetic field produces an electric current which flows along the axis of the tubular workpiece 12, represented by the small horizontal arrows pointing to the right in FIG. 1. This current, referred to as a parasitic current, begins to circulate along a path from the tubular workpiece 12 and into conveyor rolls 14 and 16 through a common ground, such as the supporting frame in which the rolls are journaled. This path is represented by the curved path shown below the conveyor rolls in FIG. 1. (Although the figure illustrates parasitic current flow in one direction, it will be understood that the parasitic current is an alternating current since the coil is excited by an ac power supply. ) This phenomenon causes arcing between the moving tubular workpiece 12 and the conveyor rolls 14 and 16, which causes pitting and other damage to the conveyor rolls.

Prior to the present invention, the most common way of preventing the flow of parasitic currents was to insulate the conveyor rolls from ground, in order to break up the current path. This involved cumbersome and expensive steps. One approach was to make the conveyor rolls out of ceramic. Ceramic conveyor rolls are very expensive, and can easily crack. Other techniques involved constructing the conveyor rolls from concentric steel inner and outer tubes insulated from each other by an intermediate insulator, such as a ceramic. Such conveyor rolls are extremely expensive to fabricate, and are subject to failure because of differential expansion and contraction between the steel and the insulating material when the rolls are subjected to the high temperatures involved in the continuous heating operation.

In some cases, no attempt was made to eliminate the parasitic currents. The currents were allowed to flow, and the conveyor rolls were periodically removed from the line and resurfaced to remove the pitting. Clearly, none of these approaches is very satisfactory.

The present invention provides a way of preventing the flow of parasitic currents. Consequently, the present invention prevents the damage to the conveyor rolls which parasitic currents cause, and eliminates the need for special conveyor rolls and insulating schemes to block the flow of parasitic currents. The present invention makes roller induction heating easier and cheaper than prior approaches.

SUMMARY OF THE INVENTION

The present invention is directed to an induction heating coil assembly for use in a roller induction heating line. The induction heating line comprises conveyor rolls for conveying a workpiece (e.g., a slab) to be inductively heated along a linear path and an induction heating coil assembly surrounding the path. The induction heating coil assembly has a central axis and comprises an induction coil and a magnetic shunt surrounding the coil. The induction coil has a plurality of turns and is shaped to define a preselected perimeter for permitting the workpiece to be received within the perimeter. The magnetic shunt includes first and second pluralities of transverse yokes at opposite ends of the coil, and a plurality of intermediate yokes spaced apart from each other. The intermediate yokes are disposed between the first and second pluralities of yokes and extend parallel to the axis of the coil. The intermediate yokes extend around the perimeter defined by the induction coil. The first and second pluralities of yokes are axially separated from each other and electromagnetically coupled together by the plurality of intermediate yokes.

In operation, the plurality of yokes function as a magnetic shunt to direct the electromagnetic field generated by the induction field along a path parallel to the axis of the coil, and thus parallel to the slab. This flux path induces eddy currents in the workpiece. However, due to the orientation of the yokes, there is no appreciable orthogonal component to the magnetic flux (i.e., there is no appreciable component perpendicular to the axis of the coil or workpiece). Accordingly, the induced eddy currents in the workpiece flow perpendicular to the axis of the workpiece. No appreciable induced parasitic eddy current flows along, or down the workpiece. Accordingly, no damaging parasitic currents circulate through the conveyor rolls.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
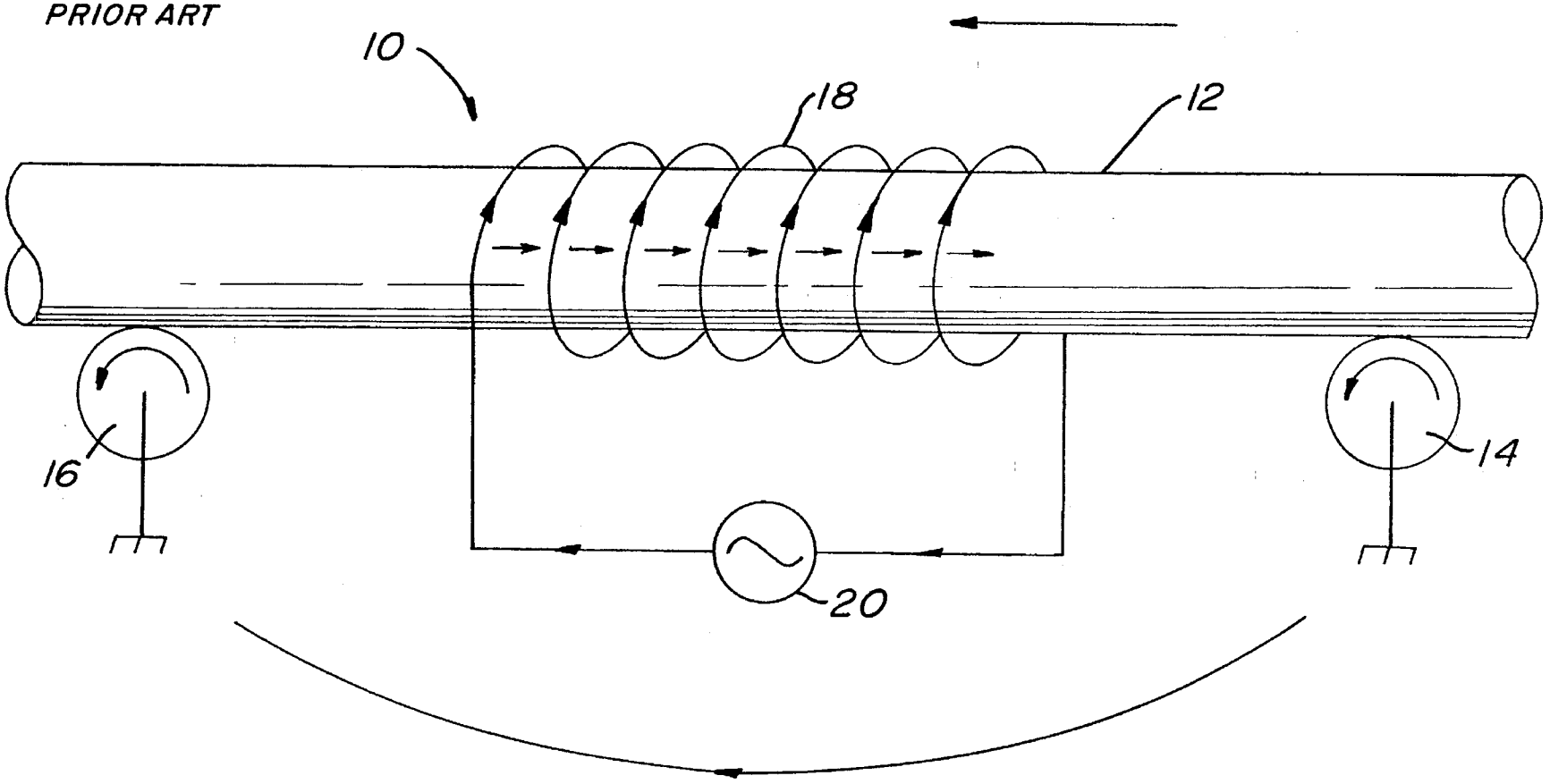
FIG. 1 PRIOR ART
FIG. 1 is a schematic representation of an induction heating coil in relation to a workpiece being heated, in accordance with the prior art.
Figure 2A:
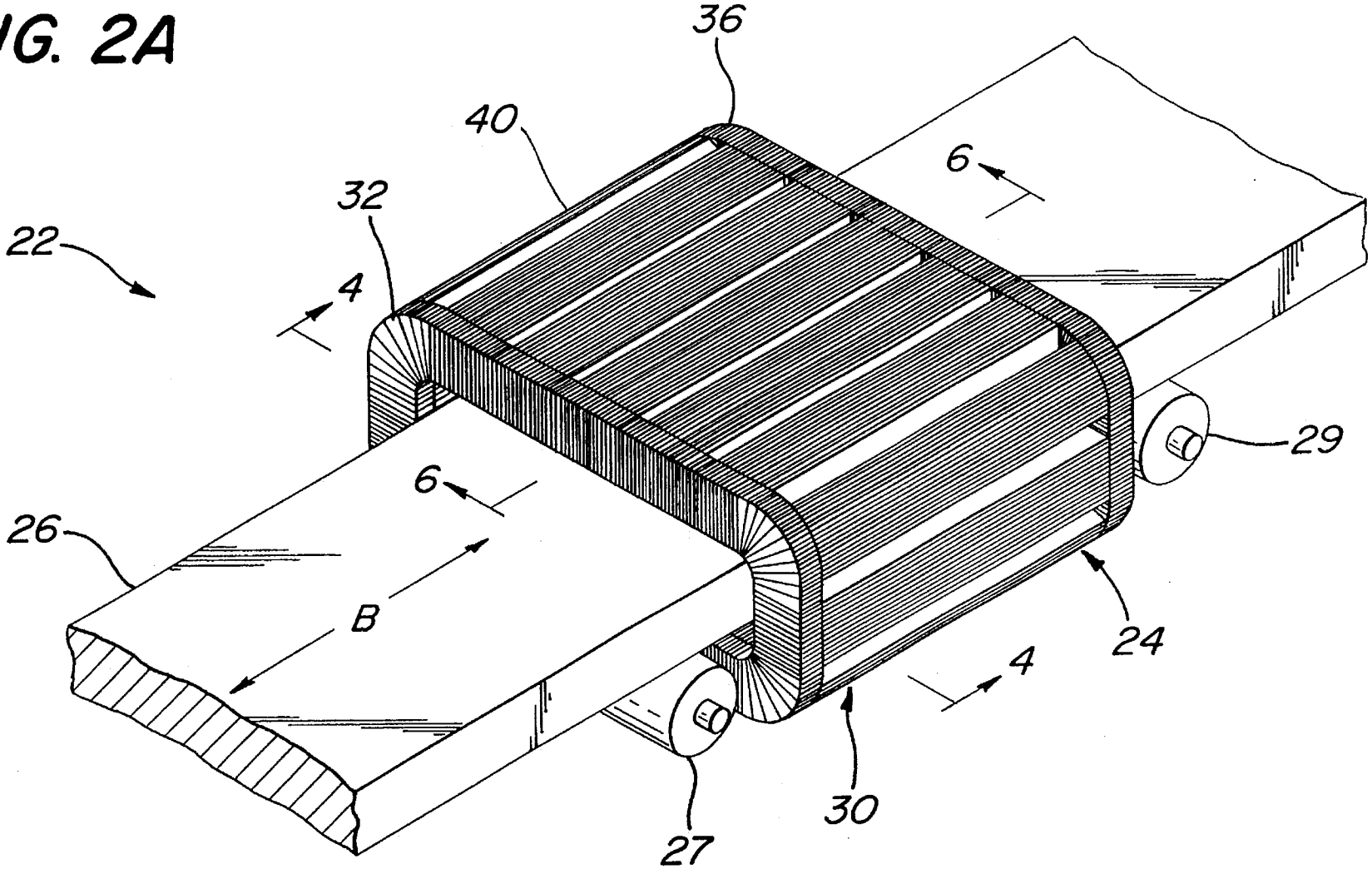
FIGS. 2A and 2B are identical perspective views of the novel induction heating coil assembly in relation to a workpiece being heated.
Figure 3:
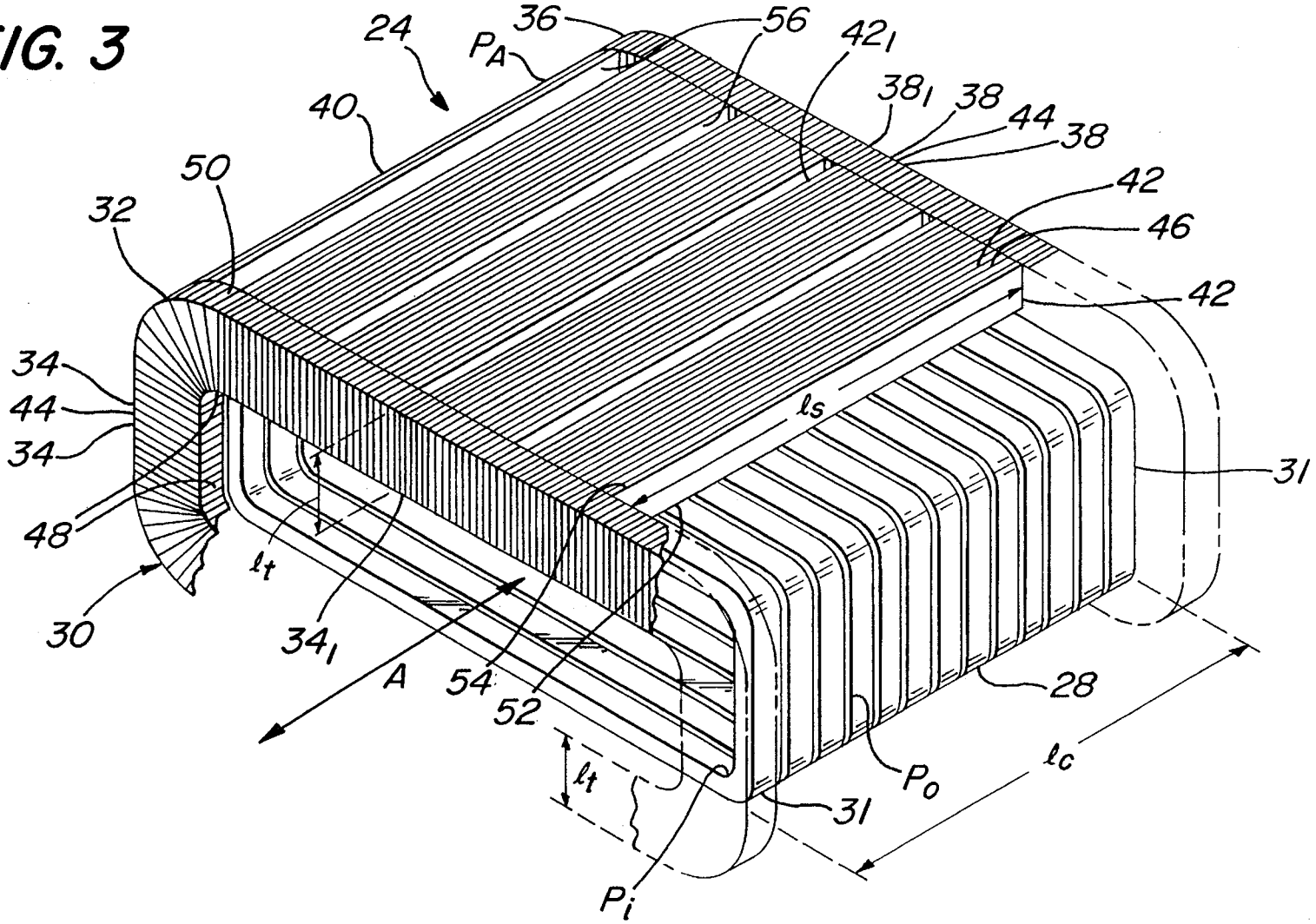
FIG. 3 is a perspective view of the novel induction heating coil assembly with a portion of the magnetic shunt removed to show the induction coil thereunder.

Referring now to the drawings, FIG. 2A shows a perspective view of roller induction heating line 22 and the novel induction heating coil assembly 24 associated therewith. FIG. 3 shows a perspective view of the novel induction heating coil assembly. For clarity, FIGS. 2A and 3 are described together. The line 22 conveys a continuous-cast workpiece such as slab 26 therealong. The line 22 may also convey workpieces having other shapes, such as the tubular workpiece 12 shown in prior art FIG. 1. As viewed in FIG. 2A, the slab 26 is linearly conveyed from right to left by steel conveyor rolls 27 and 29. These rolls operate in the same manner as described above in relation to prior art FIG. 1.

The induction heating coil assembly 24 surrounds the slab 26 so that the slab 26 passes through the coil assembly 24. The assembly 24 includes induction heating coil 28 and a magnetic shunt 30 which surrounds ends 31 and outer perimeter $P_o$ of the induction heating coil 28. The induction heating coil 28 is a conventional helically-wound coil which operates in the same manner as coil 18 described in prior art FIG. 1. The induction heating coil 28 has a central axis A and a length $l_c$. The slab 26 thus passes through an area defined by the coil's inner perimeter $P_i$ and length $l_c$. The coil 28 is preferably positioned with respect to the slab 26 so that the slab's longitudinal axis B is collinear with the induction coil's central axis A.

The magnetic shunt 30 is illustrated as having three distinct portions. The first portion comprises a first plurality 32 of individual transverse yokes 34 and the second portion comprises a second plurality 36 of individual transverse yokes 38. A third portion comprises a third plurality 40 of individual intermediate yokes 42. However, if desired, the transverse yokes and intermediate yokes may be a single unit, or joined together to form a single unit. Each plurality of individual transverse yokes 34, 38 are spaced apart from each other by identically shaped non-conductive spacers 44, in a stacked or sandwiched manner. Each plurality of individual intermediate yokes 42 are also spaced apart from each other by identically shaped non-conductive spacers 46 in a similar stacked manner. One suitable non-conductive spacer material for both types of yokes is Mylar®.

As described in more detail below, the plurality of individual transverse yokes 34, 38 extend completely around all areas of the ends 31 of the induction coil 28, whereas the intermediate yokes 42 are arranged in a plurality of groupings, each grouping separated by a relatively small air gap. These air gaps create small discontinuities along the outer perimeter $P_A$ of the assembly 24.

The specific arrangement of the yokes is an important feature of the invention. The first and second plurality of individual transverse yokes 34, 38 are oriented transverse to the outer perimeter $P_o$ of induction coil 28, and are disposed at opposite ends of the coil. Each of the individual transverse yokes 34 and 38 is defined by an inner facing planar end 48 and an outer facing planar end 50. The transverse yokes 34 and 38 are placed at opposite ends 31 of the induction coil 28 so that the yokes extend axially inward slightly past the inner perimeter $P_i$ of the induction coil 28. The non-conductive spacers 44 are oriented in the same manner as the transverse yokes 34 and 38.

Figure 4:
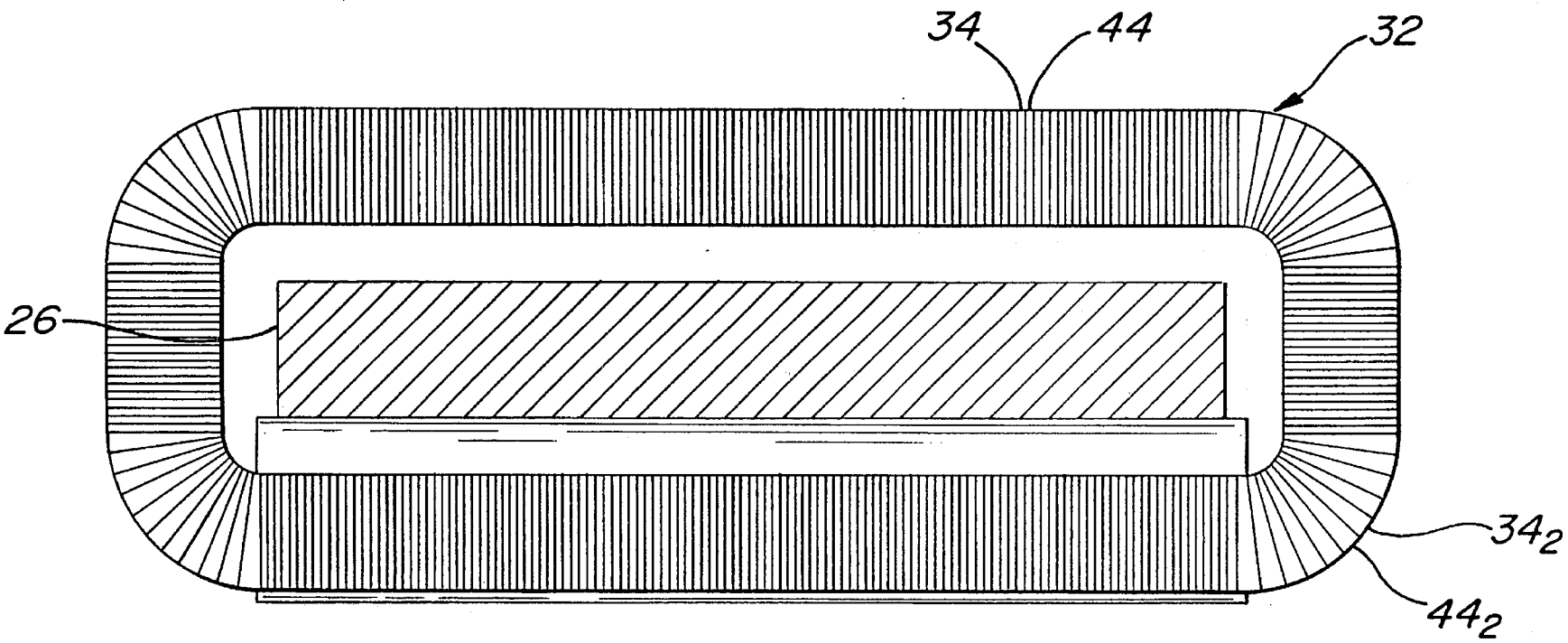
FIG. 4 is an end view taken along line 4—4 in FIG. 2A.

The transverse yokes 34, 38 and spacers 44 extend completely around, but do not touch, the ends of the perimeter of the induction coil 28. In the depicted embodiment, the yokes 34, 38 extend around the perimeter in generally the shape of a flattened oval. The transverse length $l_t$ of the yokes 34, 38 and spacers 44 is the same along the entire perimeter, and the inner and outer facing planar ends 48, 50 of the transverse yokes 34 and 38 terminate in respective common radial planes, as also illustrated in FIG. 4. To accommodate the corners of the oval configuration, the transverse yokes 34, 38 and spacers 44 along the corners are wedge-shaped.

The individual intermediate yokes 42 are disposed between the transverse yokes 34, 38 and extend parallel to the central axis A of the induction coil 28. Thus, the intermediate yokes 42 appear as radial fins extending from the induction coil 28. Each intermediate yoke 42 has a longitudinal length $l_s$, which is slightly larger than the length $l_c$ of the induction coil 28.

The plurality of intermediate yokes 42 closely surround, but do not touch, the outer perimeter $P_o$ of the induction coil 28. Each of the intermediate yokes 42 is defined by an inner facing planar end 52 and an outer facing planar end 54. The outer facing planar ends 54 of the intermediate yokes 42 terminate in the same common oval-shaped radial plane as the outer facing planar ends 50 of the transverse yokes 34 and 38. Again, the non-conductive spacers 46 are oriented in the same manner as the intermediate yokes 42.

Figure 5:
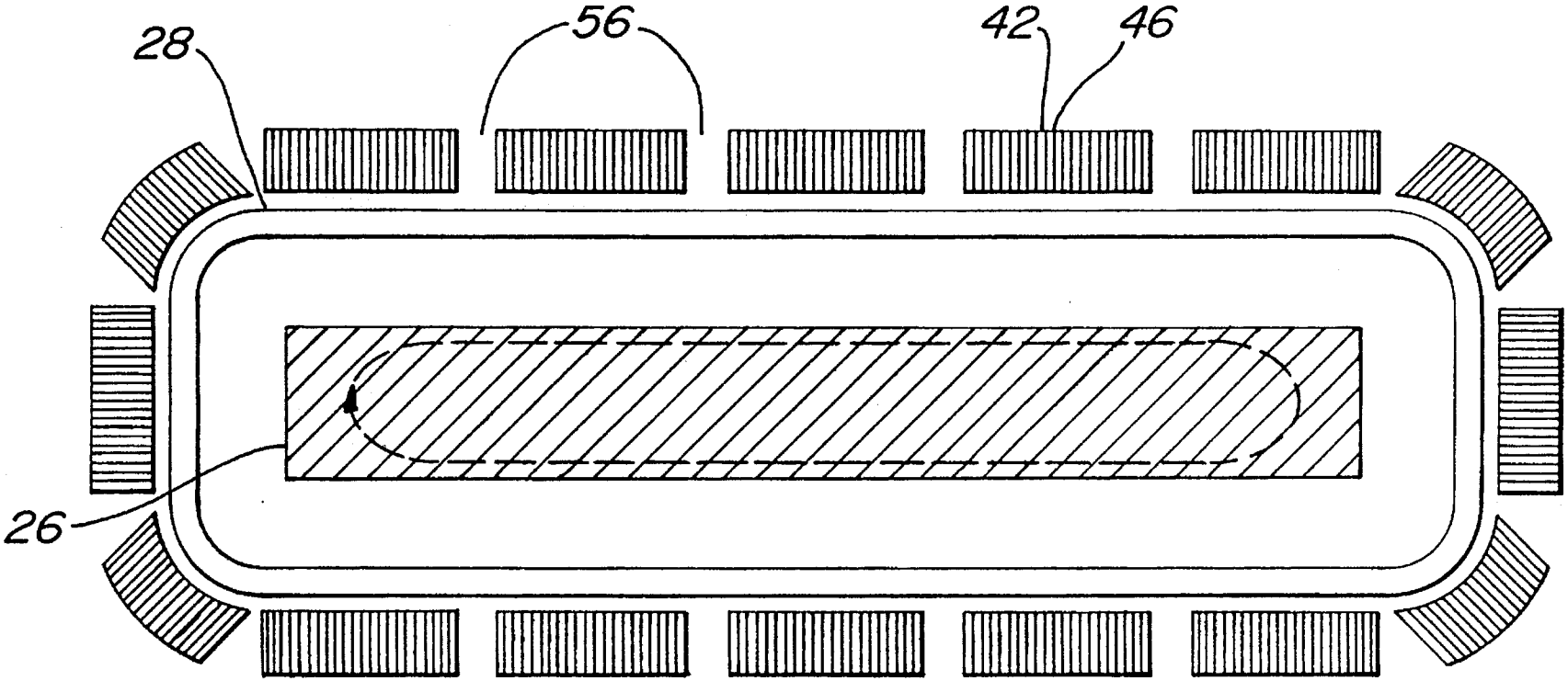
FIG. 5 is a transverse sectional view taken through line 5—5 in FIG. 6.

The transverse yokes 34 and 38 extend around the entire perimeter of respective ends of the induction coil 28, whereas the intermediate yokes 42 are arranged in spaced groupings, separated by small air gaps 56. In the embodiment described herein, there are sixteen such groupings, as best illustrated in FIG. 5.

The first and second plurality of individual transverse yokes 34, 38 are electromagnetically coupled together by respective intermediate yokes 42 which lie in the same, or closely adjacent, plane. For example, in FIG. 3, transverse yokes $34_1$ and $38_1$ are coupled together by intermediate yoke $42_1$. This electromagnetic coupling allows magnetic flux to flow easily along the length of the magnetic shunt 30. Due to the air gaps 56, not all of the transverse yokes 34, 38 are electromagnetically coupled together by a respective intermediate yoke 42 in the same plane. These pairs of transverse yokes 34, 38 are electromagnetically coupled by way of adjacent intermediate yokes 42. Since the air gaps 56 are relatively small compared to the length of the overall magnetic flux path, there will be a small but relatively inconsequential divergence in the magnetic flux path at each end.

Figure 2B:
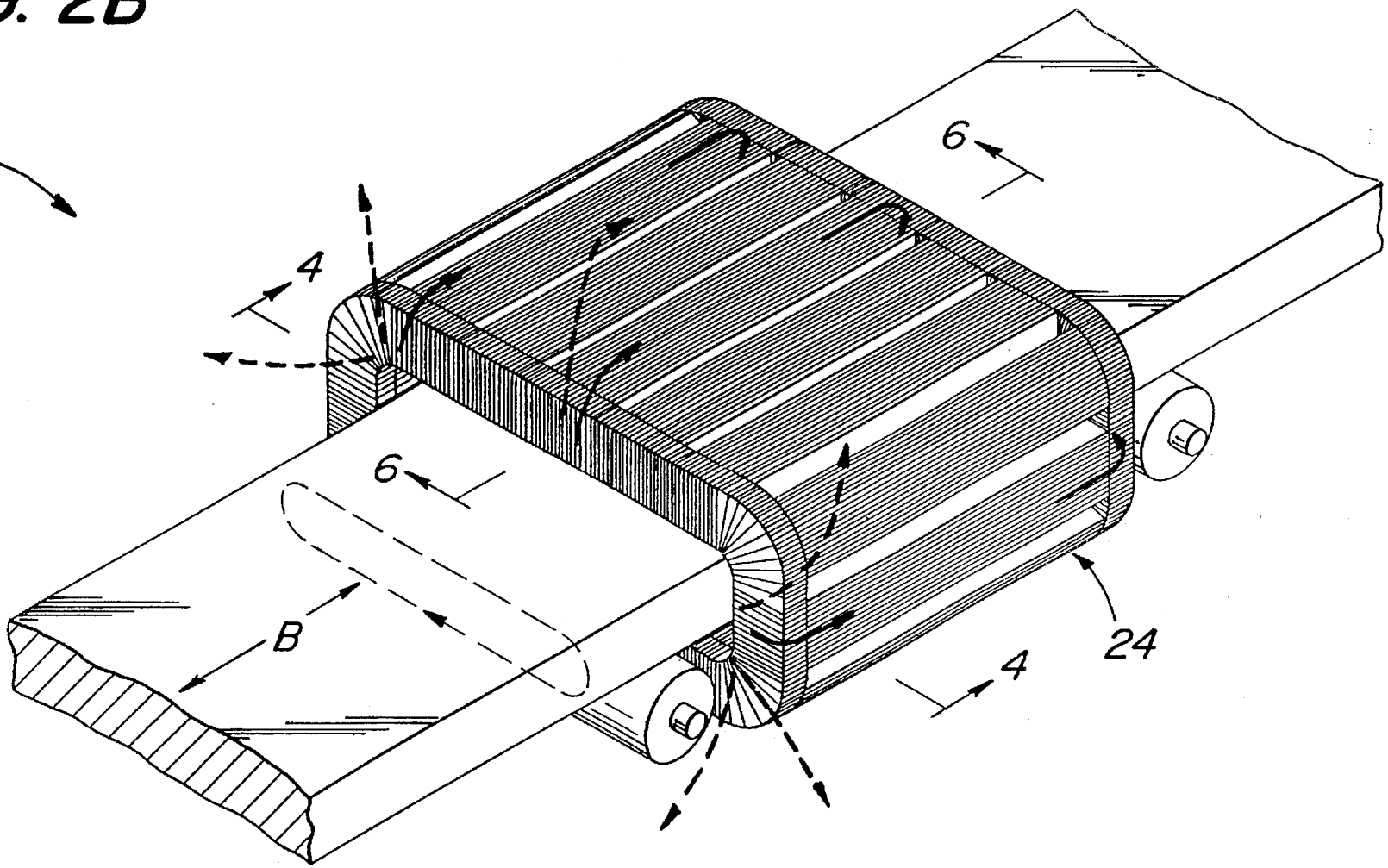

FIG. 2B is identical to FIG. 2A and illustrates the functional advantage of the induction heating coil assembly 24 during operation of the roller induction heating line 22. When power is applied to the induction coil 28 (not visible in this view), the induction coil 28 generates an electromagnetic field which has components along both a path parallel and perpendicular to the central axis A (not shown) of the induction coil 28. The perpendicular component is very small compared to the parallel component, but is nevertheless large enough to be problematic if not eliminated. The plurality of yokes in the magnetic shunt 30 direct both components of the electromagnetic field along a path parallel to the central axis A of the induction coil 28, and thus parallel to the longitudinal axis B of the slab 26. The magnetic flux induces eddy currents in the slab 26. Since the transverse yokes 34, 38 and the intermediate yokes 42 are oriented parallel to the longitudinal axis B of the slab 26, substantially all the magnetic flux is directed along this path. This path is shown in FIG. 2B as a series of solid line arrows. There is no appreciable orthogonal component to the magnetic flux. That is, there is no appreciable component perpendicular to the longitudinal axis B of the slab 26. Accordingly, the induced eddy current in the slab 26 flows primarily perpendicular to the slab's longitudinal axis B. This eddy current is shown in FIG. 2B as a dashed line arrow in the slab 26, and is best illustrated in FIG. 5. No appreciable induced parasitic eddy currents flow along, or down the longitudinal axis B of the slab 26. Accordingly, no damaging parasitic currents circulate through the conveyor rolls 27 and 29.

If the magnetic shunt 30 were not present, the electromagnetic field would spread out in all directions at the ends of the induction coil 28, as shown by the imaginary dotted line arrows, and would have a non-negligible orthogonal component. Accordingly, non-negligible parasitic eddy currents would be induced to flow in the slab 26 along the slab's longitudinal axis B, causing the problems discussed above.

Figure 6:
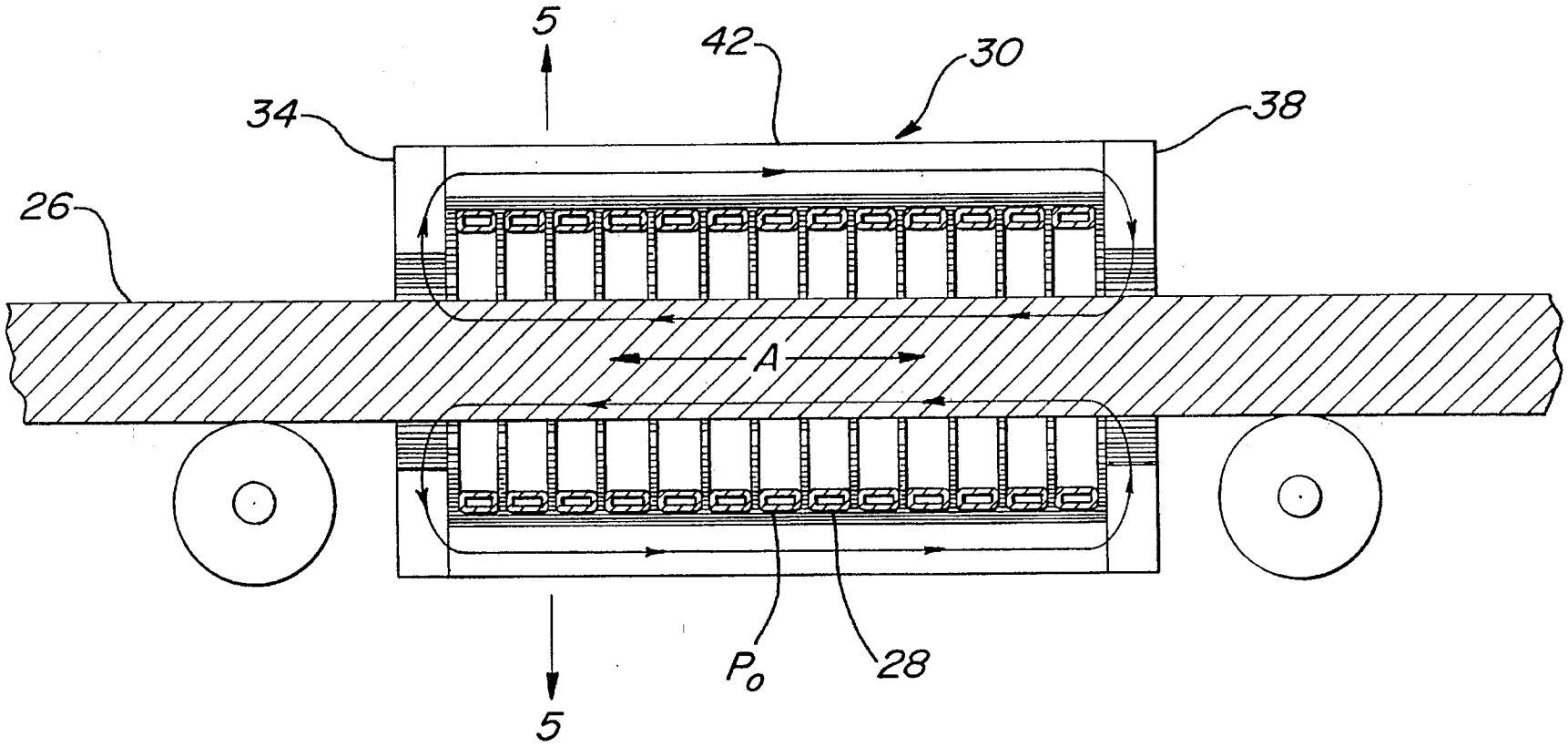
FIG. 6 is a longitudinal sectional view taken through line 6—6 in FIG. 2A.

FIGS. 4, 5 and 6 show end and sectional views taken through FIG. 2A, and more clearly illustrate certain features of the invention.

FIG. 4 is an end view taken through line 4—4 in FIG. 2A. This view shows the arrangement of the alternating first plurality 32 of individual transverse yokes 34 and non-conductive spacers 44 which completely surround the end of the induction coil 28. Since the yokes 34 and spacers 44 are sandwiched or stacked together, the induction coil 28 is not visible in this view. FIG. 4 also clearly shows the wedge-shaped transverse yokes (e.g., $34_2$) and spacers (e.g., $44_2$) along the corners of the oval configuration. The slab 26 to be heated is centrally disposed within the surrounding transverse yokes 34.

FIG. 5 is a transverse sectional view taken through line 5—5 in FIG. 6. This view shows the sixteen spaced groupings of intermediate yokes 42 and spacers 46, separated by small air gaps 56. One turn of the induction coil 28 is also visible in this view. FIG. 5 also shows the induced eddy current as a dashed line arrow in the slab 26. Of course, the direction of this current alternates at the same frequency as the alternating current source used excite the induction coil 28. The direction shown in FIG. 5 is that at a given instant of time.

FIG. 6 is a longitudinal sectional view taken through line 6—6 in FIG. 2A. This view shows a portion of the magnetic shunt 30 made up of two transverse end yokes 34, 38 and a connecting intermediate yoke 42 disposed in the same longitudinal plane. The plurality of turns of the induction coil 28 are also visible in this view. FIG. 6 also shows that the magnetic shunt 30 surrounds the ends and outer perimeter $P_o$ of the induction coil 28. As described above, the yokes of the magnetic shunt 30 provide a magnetic flux path for the component of electromagnetic field along the central axis A of the induction coil 28. The path through the yokes 34, 42, 38 and slab 26 is shown as a solid line arrow. Again, it should be understood that the direction of the path alternates at the same frequency as the alternating current source used excite the induction coil 28. The direction shown in FIG. 6 is that at a given instant of time.

Figure 7:
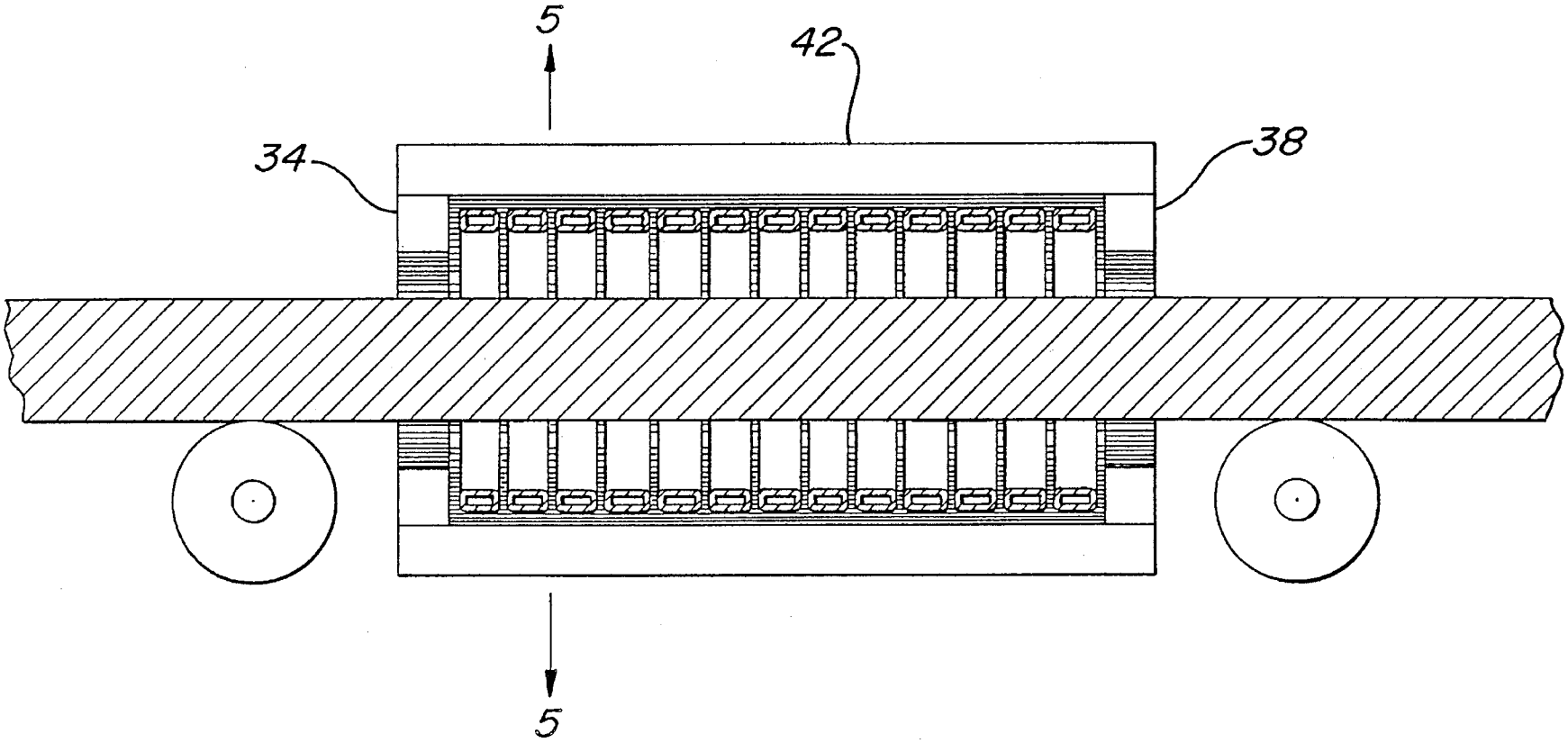
FIGS. 7 and 8 are longitudinal sectional views taken through line 6—6 of an alternative embodiment of FIG. 2A.
Figure 8:
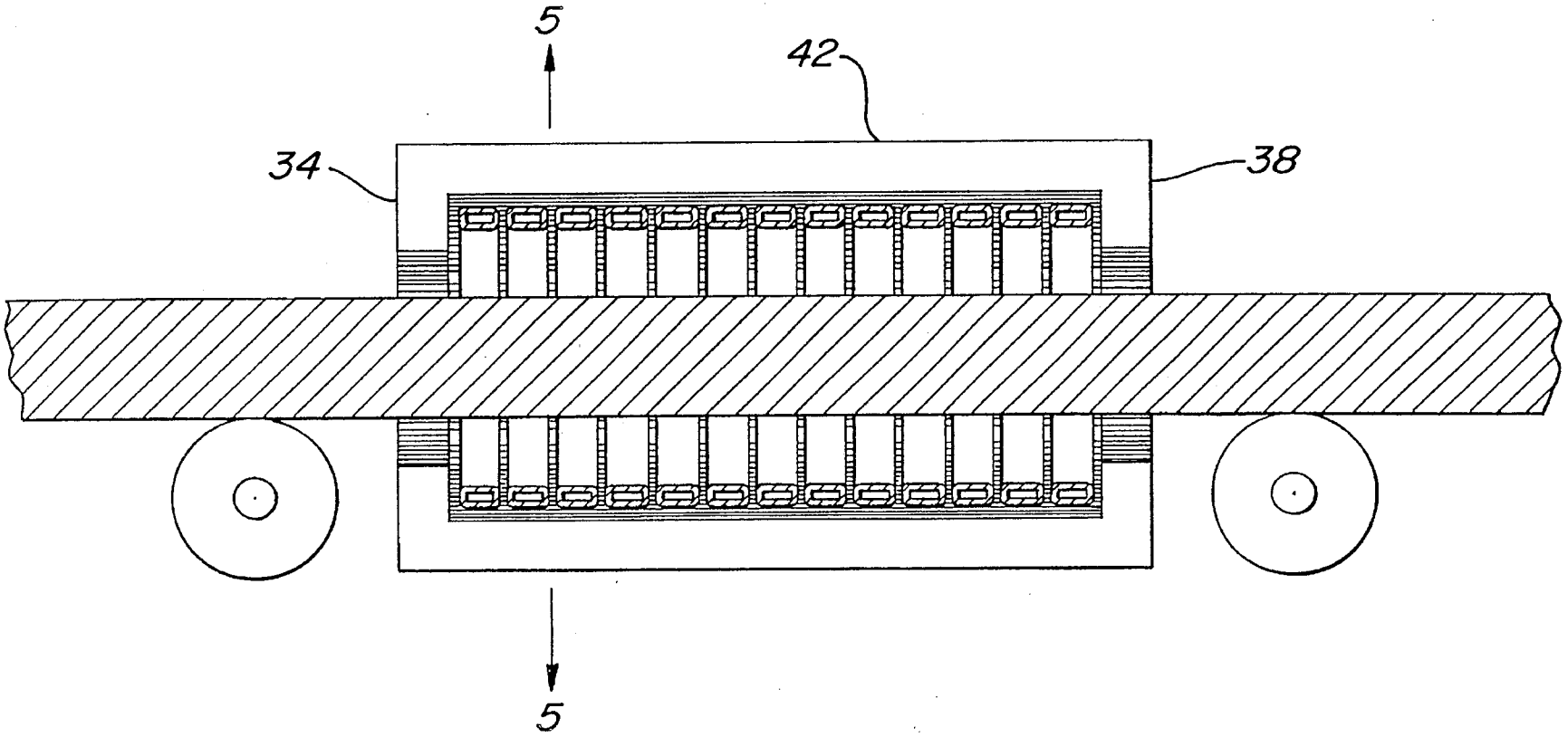

Magnetic shunts 30 may be constructed in a plurality of different ways, as shown in FIGS. 7 and 8.

In FIG. 7, the transverse end yokes 34, 38 are shorter in length and the intermediate yoke 42 is longer at each end to overlap end yokes 34 and 38. In FIG. 8, the transverse end yokes 34, 38 and the intermediate yoke 42 are formed as one continuous piece of material. The non-conductive spacers 44 and 46 may also be constructed in the same alternate configurations as the yokes.

The embodiment of the invention as illustrated and described is employed for heating rectangular-shaped loads or workpieces, such as slabs. However, the scope of the invention includes embodiments for heating other load shapes, such as tubular or cylindrical workpieces. In these alternative embodiments, the coil 28 and magnetic shunt 30 would be generally circular, not oval, in transverse section.

It will be appreciated that the coil assembly 24 will be subjected to very large mechanical forces as a result of magnetic interaction between the coil 28 and the workpiece. In a large installation, these forces could amount to several tons. Normally, in a typical cylindrical induction coil, these forces are evenly distributed about the circumference of the coil, and are therefore in balance, or radial symmetry, around the periphery of the coil. However, in the present situation, where the coil is a flattened oval, the forces will not be symmetric around the coil periphery, and there will be resulting net forces of substantial magnitude between the coil and the workpiece. To aid in strengthening coil assembly 28, the magnetic shunts may be clamped tightly against the coil turns, as shown in FIG. 9.

Figure 9:
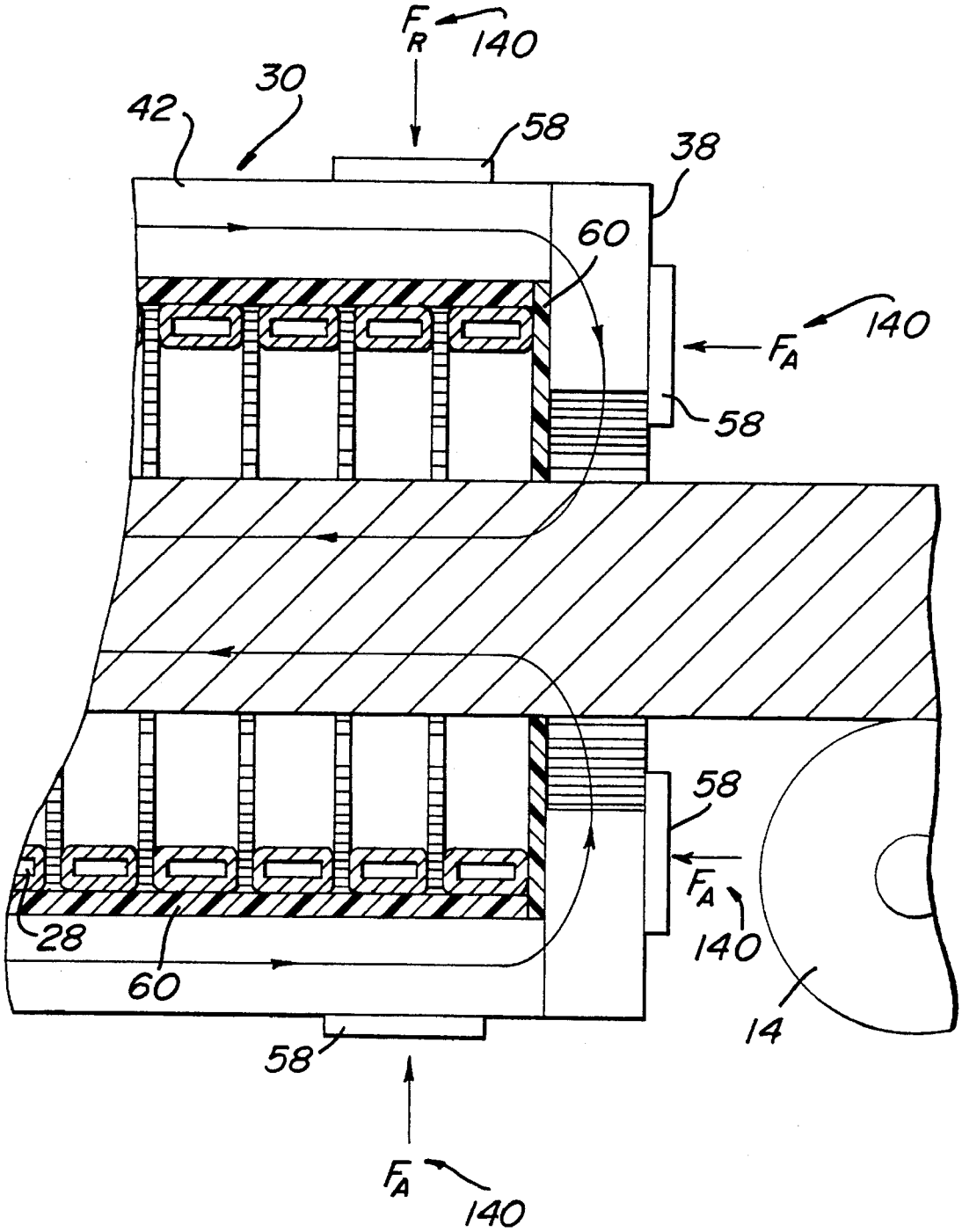
FIG. 9 is a partial sectional view of a coil assembly according to the invention in greater detail, showing insulating layers between the magnetic shunts and the coil turns.

FIG. 9 illustrates a plurality of clamps 58 on intermediate yokes 42 and on transverse end yokes 38. Clamps 58 apply compressive forces on the coil turns. The compressive forces on the intermediate yokes 42 are radial, as represented by arrows $F_R$, and the compressive forces on the end yokes 38 are axial, as represented by arrows $F_A$. Clamps 58 may have any shape or structure designed to apply the compressive forces to the yokes and coil. To prevent electric shorting between the coil turns, the yokes are insulated from the coil turns by insulating spacers 60. Spacers 60 may be any suitable nonconducting, nonmagnetic material.

Figure 10:
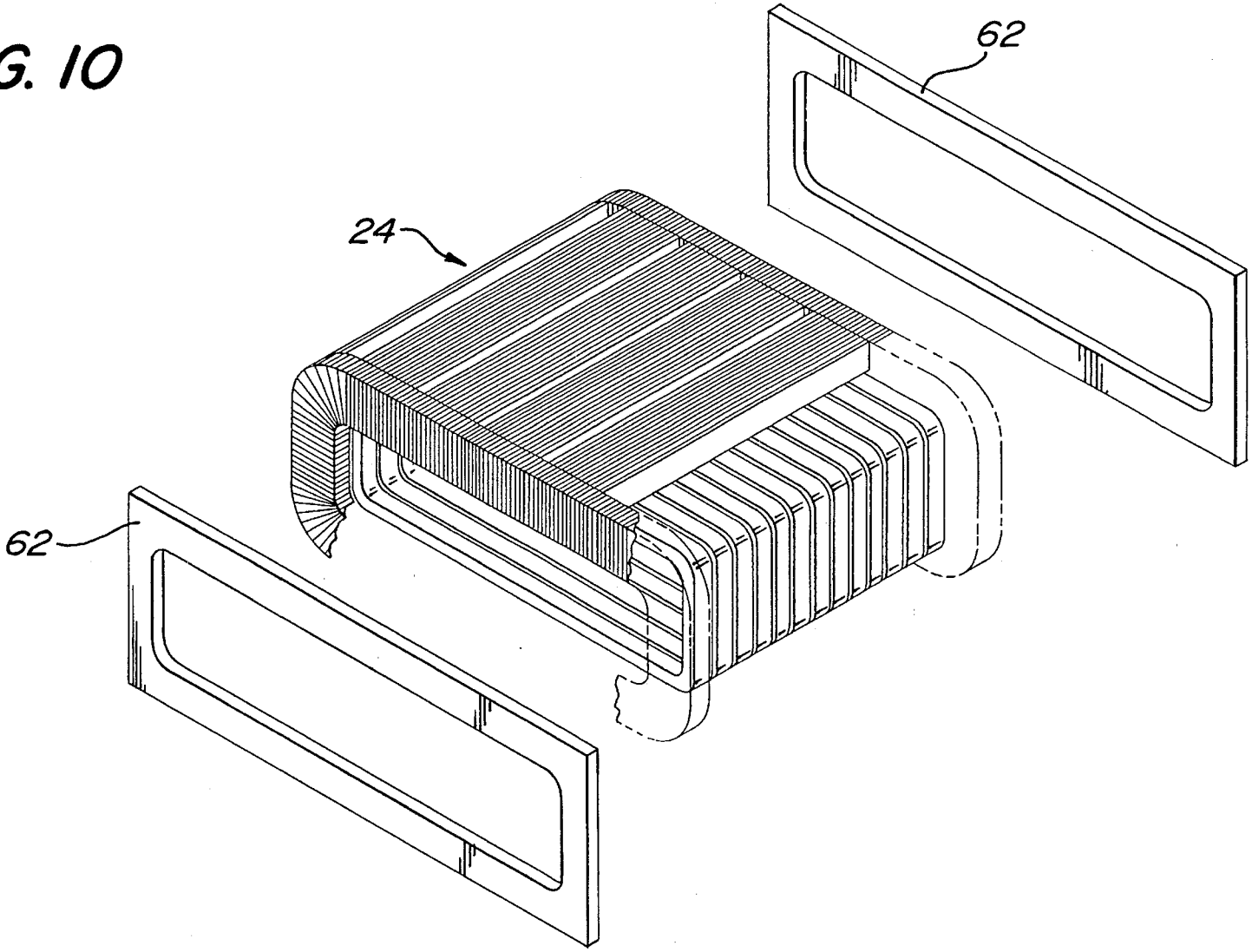
FIG. 10 is an exploded view of a coil assembly according to the invention, showing optional magnetic shunt end plates.

While the shunt arrangements already described are highly effective in directing the magnetic flux produced by the coil 28, it is possible to improve performance even more by using electrically-conductive magnetic flux deflecting end plates, as shown in FIG. 10. FIG. 10 is an exploded view of a coil assembly 24 which includes end plates 62 at each end of coil assembly 24. End plates 62 are generally rectangular in shape and have dimensions slightly greater than the overall outside dimensions of coil assembly 24. Each end plate 62 has a generally rectangular opening 64 in its center to accommodate passage of a workpiece through the opening. Opening 64 is approximately the same size and shape as the opening in coil assembly 24 through which the workpiece passes. End plates are preferably made of copper, which is a good conductor of electricity and deflects the magnetic flux with minimal losses. The end plates 62 are located adjacent and axially outside the end yokes 34 and 38. Preferably, the end plates are located a short distance from the end yokes, and should not touch the end yokes. It is within the secope of the invention to place an insulating spacer between the end plates 62 and the end yokes, if it is desired to also clamp the end plates 62 against the end yokes to further compress the induction coil 28.

Even with the use of the shunt assemblies previously described, stray magnetic flux from coil assembly 24 may reach the rollers 14 and 16, particularly if the rollers are in close proximity to the ends of the coil assembly. This stray flux may induce parasitic currents to flow in the rollers, and negate the effect of the shunts. The end plates 62 direct any stray flux which might otherwise escape from the center opening of coil assembly 24 to the end yokes 34 and 38, and from there to the intermediate yokes 42. In addition, the end plates 62 significantly improve the flux concentration within the coil.

The invention described above provides an alternative approach to preventing the flow of significant parasitic currents along a workpiece, thereby eliminating arcing between the moving workpiece and the conveyor rolls. Since it is no longer necessary to employ special conveyor rolls or insulating schemes to prevent damage to the conveyor rolls from such currents, roller induction heating becomes easier and cheaper than prior approaches.

The present invention may be embodied in other specific forms without departing from the spirit or essential attributes thereof and, accordingly, reference should be made to the appended claims, rather than to the foregoing specification, as indicating the scope of the invention.

We claim:

1. A roller induction heating line, comprising conveyor rolls for conveying a workpiece to be inductively heated along a linear path and an induction heating coil assembly surrounding the path, the induction heating coil assembly having a central axis substantially collinear with said path and a preselected axial length and comprising an induction coil having a plurality of turns and being shaped to define a preselected perimeter for permitting the workpiece to be received within the perimeter and conveyed therethrough along said path, first and second pluralities of transverse yokes at opposite ends of the coil, and a plurality of intermediate yokes spaced apart from each other, and disposed between said first and second pluralities of transverse yokes and extending parallel to the central axis of the coil assembly, said first and second pluralities of transverse yokes and said plurality of intermediate yokes surrounding the coil, said intermediate yokes extending around a major portion of the perimeter defined by said induction coil, said first and second yokes being axially separated from each other and electromagnetically coupled together by said plurality of intermediate yokes.

2. A roller induction heating line according to claim 1 wherein the first and second pluralities of transverse yokes extend around the entire opposite ends of the coil.

3. A roller induction heating line according to claim 2 wherein the intermediate yokes are arranged in spaced groupings.

4. A roller induction heating line according to claim 1 wherein the plurality of intermediate yokes extend radially from the induction coil.

5. A roller induction heating line according to claim 1 wherein the induction coil is helical.

6. A roller induction heating line according to claim 1 wherein adjacent first and second transverse yokes and adjacent intermediate yokes are separated by non-conductive spacers.

7. A roller induction heating line according to claim 1 wherein each of the intermediate yokes is co-planar with a respective pair of axially separated transverse yokes.

8. A roller induction heating line according to claim 1 wherein the first and second pluralities of transverse yokes and the plurality of intermediate yokes are arranged in a generally oval configuration in transverse section.

9. A roller induction heating line according to claim 1 wherein said first and second pluralities of transverse yokes and said plurality of intermediate yokes are formed as one continuous piece of material.

10. An induction heating coil assembly according to claim 1, further comprising clamps acting on the transverse and intermediate yokes for applying both axial and radial compressive forces on the induction coil.

11. An induction heating coil assembly according to claim 10, including non-magnetic insulators between the yokes and the induction coil.

12. An induction heating coil assembly according to claim 1, further comprising electrically-conductive magnetic flux deflecting end plates adjacent and axially outside the transverse yokes.

* * * * *